US010334995B1

(12) United States Patent
Butler

(10) Patent No.: US 10,334,995 B1
(45) Date of Patent: Jul. 2, 2019

(54) DECORATIVE COVER FOR A PAPER TOWEL ROLL AND HOLDER

(71) Applicant: Stephanie Butler, Indianapolis, IN (US)

(72) Inventor: Stephanie Butler, Indianapolis, IN (US)

( * ) Notice: Subject to any disclaimer, the term of this patent is extended or adjusted under 35 U.S.C. 154(b) by 10 days.

(21) Appl. No.: 15/671,233

(22) Filed: Aug. 8, 2017

(51) Int. Cl.

| | |
|---|---|
| ***A47K 10/24*** | (2006.01) |
| ***A47K 10/22*** | (2006.01) |
| ***B65D 83/08*** | (2006.01) |
| ***A47K 10/38*** | (2006.01) |

(52) U.S. Cl.
CPC ..... *A47K 10/22* (2013.01); *A47K 10/3827* (2013.01); *B65D 83/0805* (2013.01)

(58) Field of Classification Search
CPC ..... A47K 10/24; A47K 10/32; B65D 85/66
USPC ..... 206/409
See application file for complete search history.

(56) References Cited

U.S. PATENT DOCUMENTS

| | | | | |
|---|---|---|---|---|
| 3,843,071 | A * | 10/1974 | Graham | A47K 10/38 206/397 |
| 4,957,246 | A * | 9/1990 | Kantor | A47K 10/32 150/154 |
| 5,598,987 | A * | 2/1997 | Wachowicz | B65H 35/0006 242/597.8 |
| D389,683 | S * | 1/1998 | Herrera | D6/522 |
| 5,763,984 | A | 6/1998 | Day | |
| D422,170 | S | 4/2000 | Harris, Jr. | |
| 6,290,169 | B1 | 9/2001 | Hartley | |
| D450,961 | S | 11/2001 | Loud | |
| 2004/0004013 | A1 | 1/2004 | Dieter | |
| 2004/0069894 | A1 | 4/2004 | Murawski | |
| 2006/0201841 | A1 | 9/2006 | Mohr | |
| 2010/0006694 | A1 | 1/2010 | Bond | |

FOREIGN PATENT DOCUMENTS

| | | |
|---|---|---|
| CN | 201208227 | 3/2009 |
| CN | 201445449 | 5/2010 |

* cited by examiner

*Primary Examiner* — Anthony D Stashick
*Assistant Examiner* — Raven Collins
(74) *Attorney, Agent, or Firm* — Kyle A. Fletcher, Esq.

(57) ABSTRACT

The decorative cover for a paper towel roll and holder is configured for use with a paper towel roll. The decorative cover for a paper towel roll and holder is placed over the paper towel roll for decorative purposes. The paper towel roll may be mounted on a paper towel holder. The decorative cover for a paper towel roll and holder comprises a cylinder, a top cap, and a slot. The cylinder is defined with a vertical face, a superior base, and an inferior base. The vertical face encloses the paper towel roll. The top cap encloses the superior base of the cylinder. The slot is an aperture formed in the vertical face. The free end of the paper towel roll is threaded through the slot such that paper towels may be drawn out of the paper towel roll without removing the decorative cover for a paper towel roll and holder.

19 Claims, 8 Drawing Sheets

DECORATIVE COVER FOR A PAPER TOWEL ROLL AND HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including sanitary equipment, more specifically, an accessory configured for use a paper towel holder.

SUMMARY OF INVENTION

The decorative cover for a paper towel roll and holder is configured for use with a paper towel roll. The decorative cover for a paper towel roll and holder is placed over the paper towel roll for decorative purposes. The paper towel roll may be mounted on a paper towel holder. The decorative cover for a paper towel roll and holder comprises a cylinder, a top cap, and a slot. The cylinder is defined with a vertical face, a superior base, and an inferior base. The vertical face encloses the paper towel roll. The top cap is a disk that encloses the superior base of the cylinder. The slot is an aperture formed in the vertical face of cylinder. The free end of the paper towel roll is threaded through the slot such that paper towels may be drawn out of the paper towel roll without removing the decorative cover for a paper towel roll and holder.

These together with additional objects, features and advantages of the decorative cover for a paper towel roll and holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the decorative cover for a paper towel roll and holder in detail, it is to be understood that the decorative cover for a paper towel roll and holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the decorative cover for a paper towel roll and holder.

It is therefore important that the claims be regarded as including such equivalent construction insofar as they do not depart from the spirit and scope of the decorative cover for a paper towel roll and holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
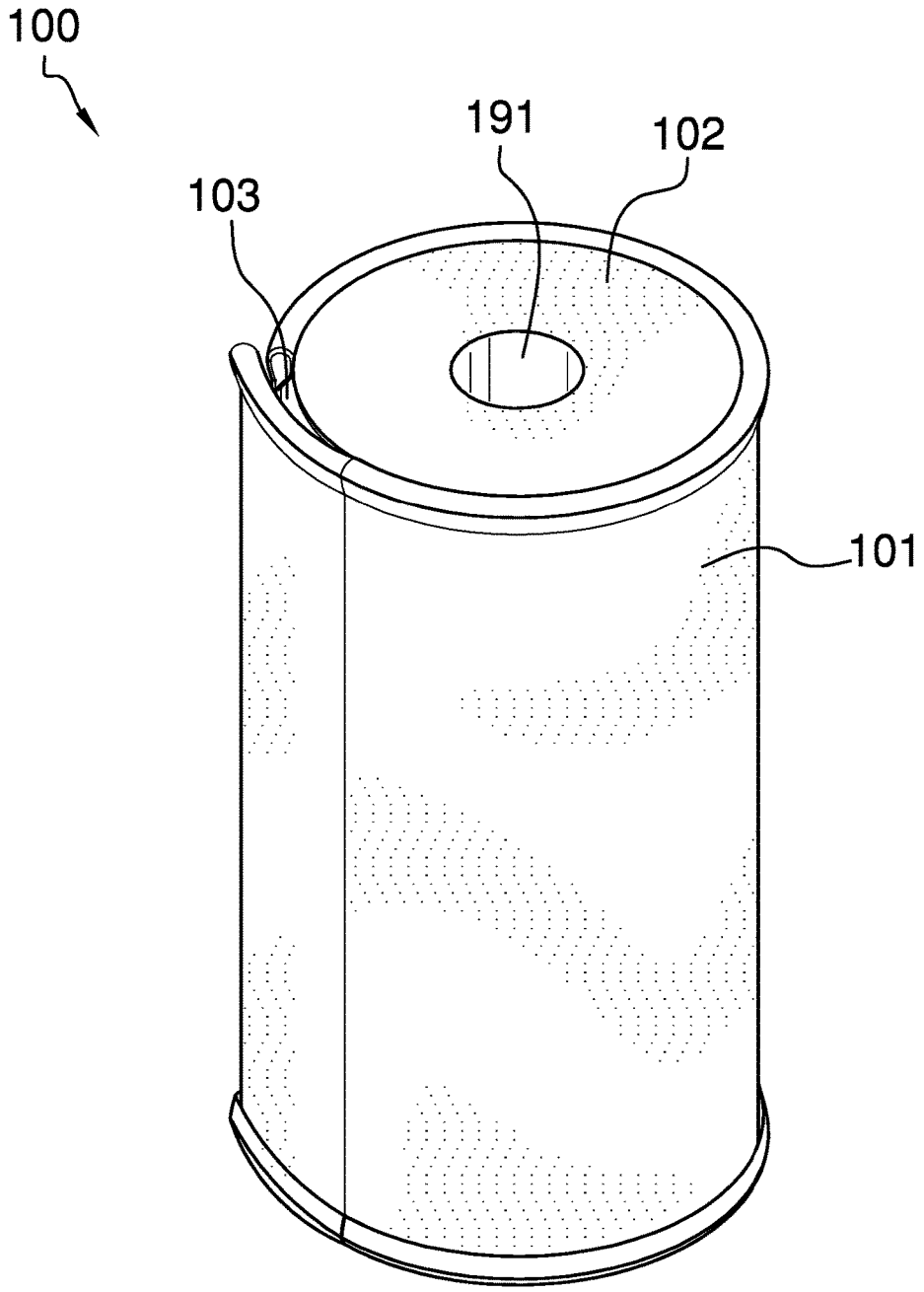
FIG. 1 is a perspective view of an embodiment of the disclosure.
Figure 2:
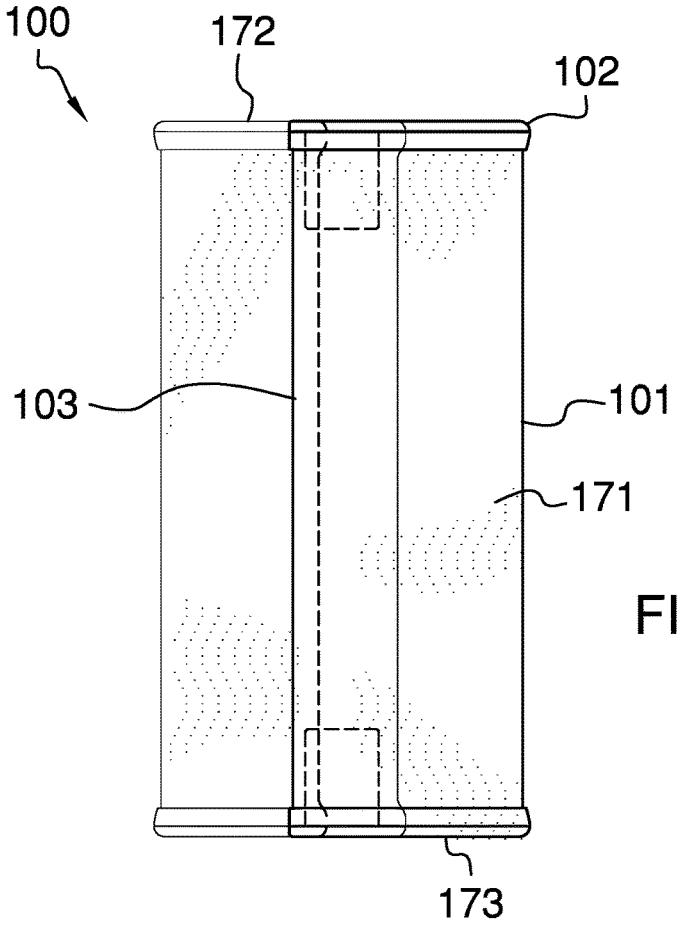
FIG. 2 is a front view of an embodiment of the disclosure.
Figure 3:
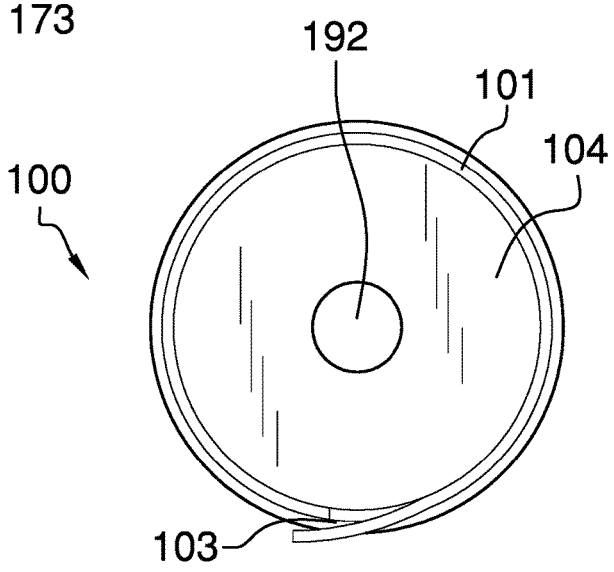
FIG. 3 is a bottom view of an embodiment of the disclosure.
Figure 4:
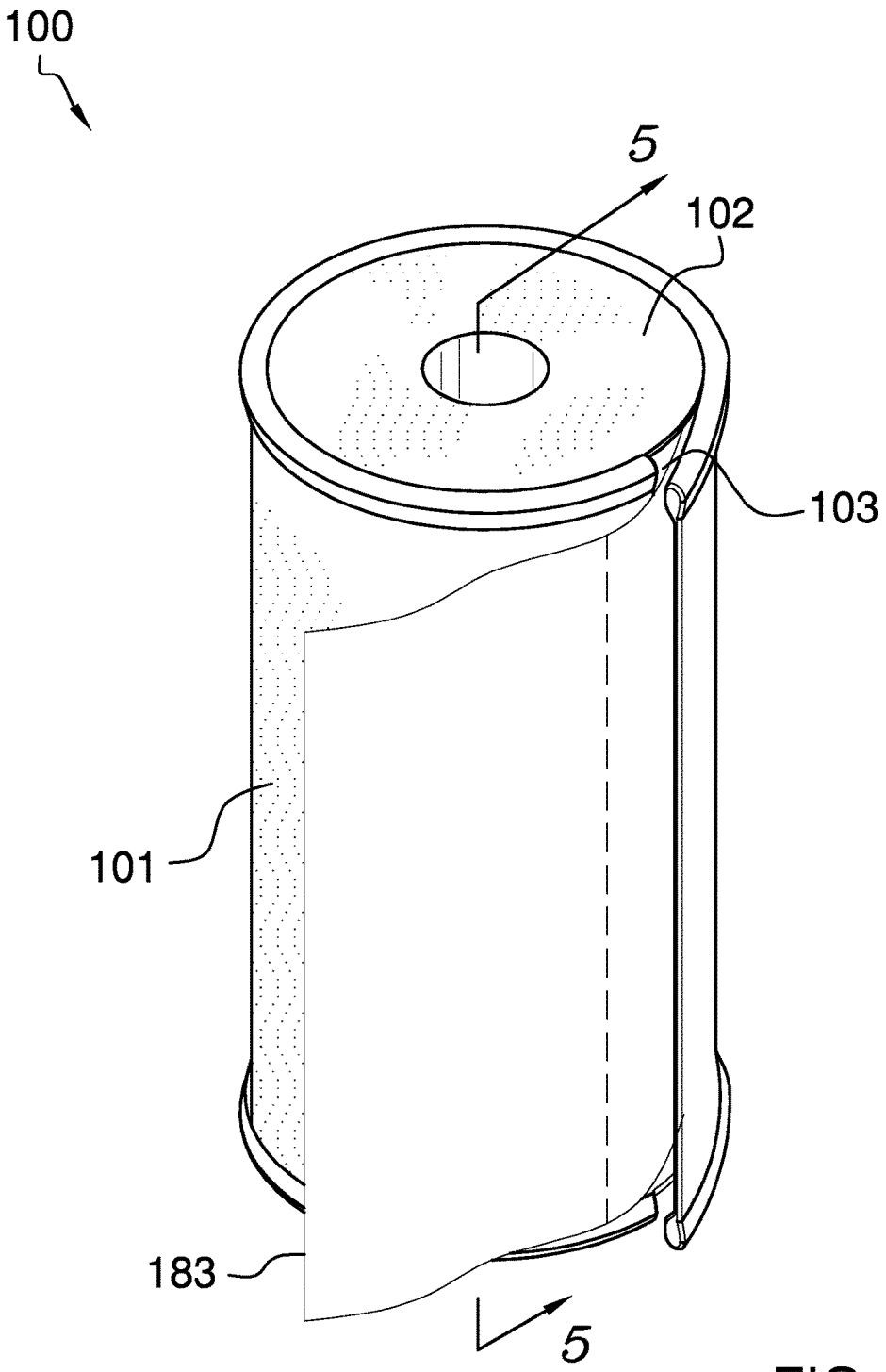
FIG. 4 is an in use view of an embodiment of the disclosure.
Figure 5:
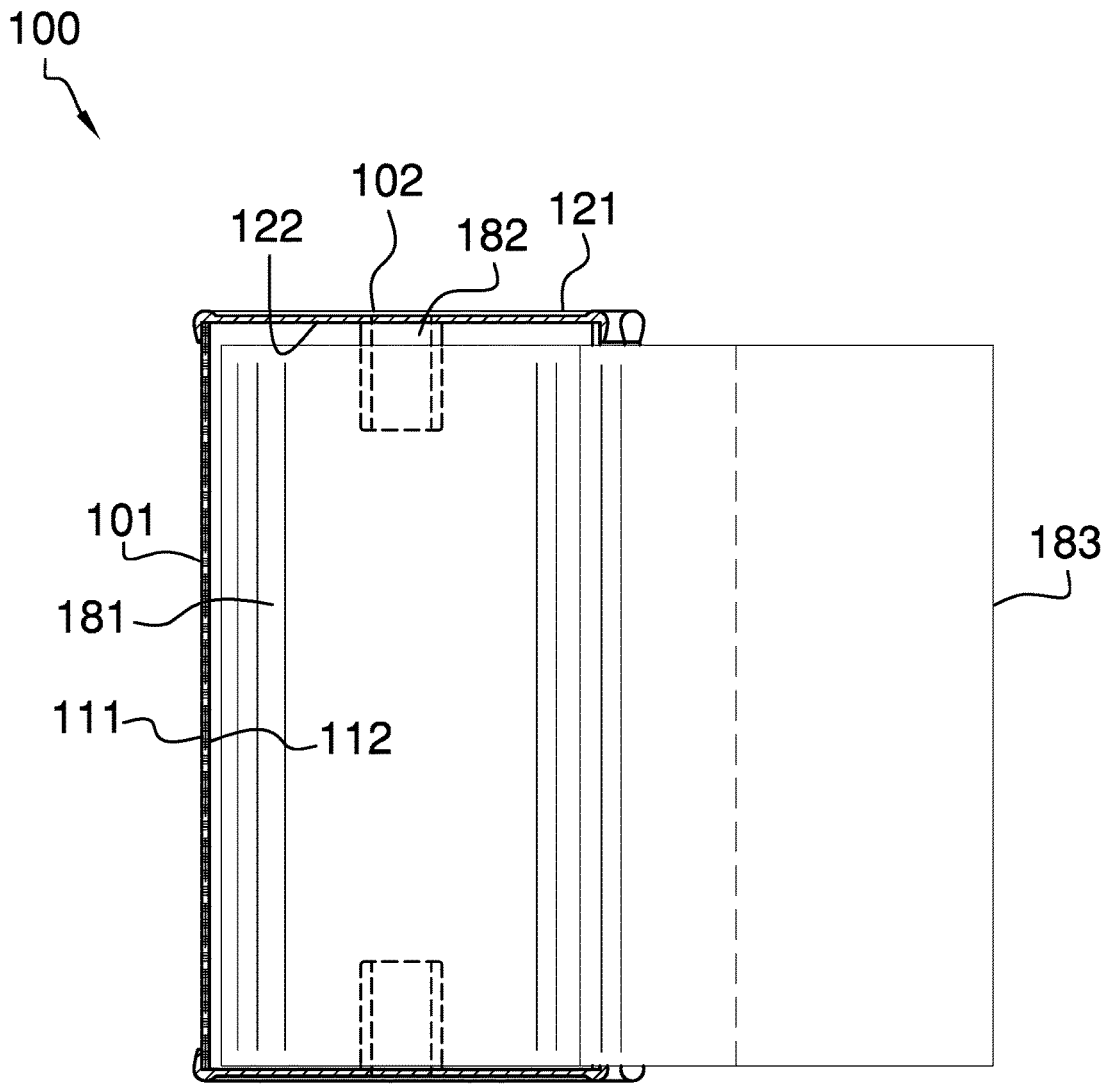
FIG. 5 is a cross-sectional view of an embodiment of the disclosure across 5-5 as shown in FIG. 4.
Figure 6:
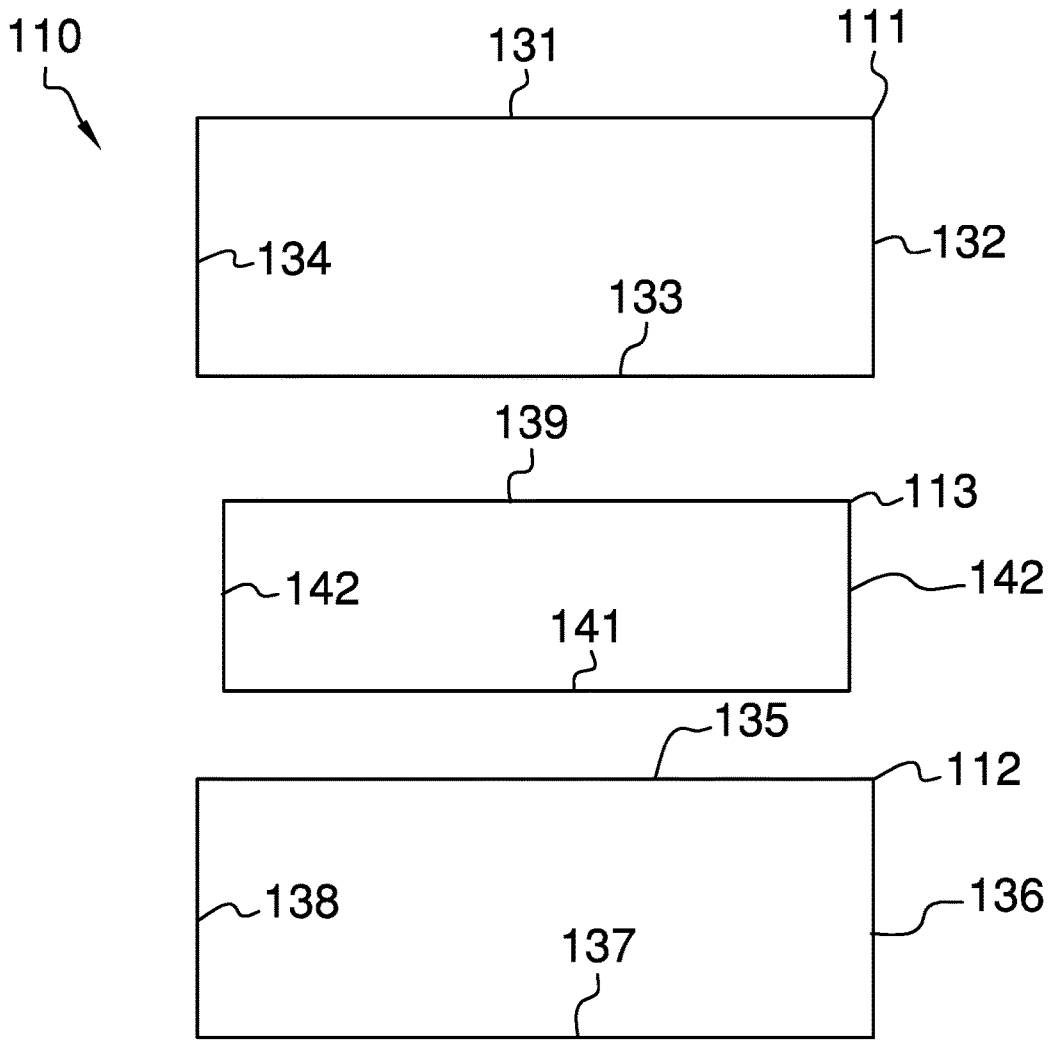
FIG. 6 is a detail view of an embodiment of the disclosure.
Figure 7:
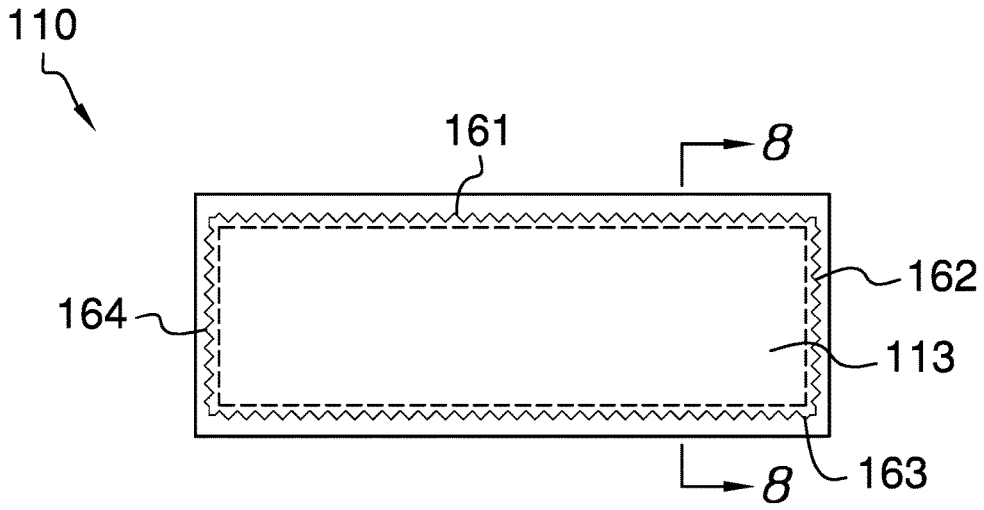
FIG. 7 is a detail view of an embodiment of the disclosure.
Figure 8:
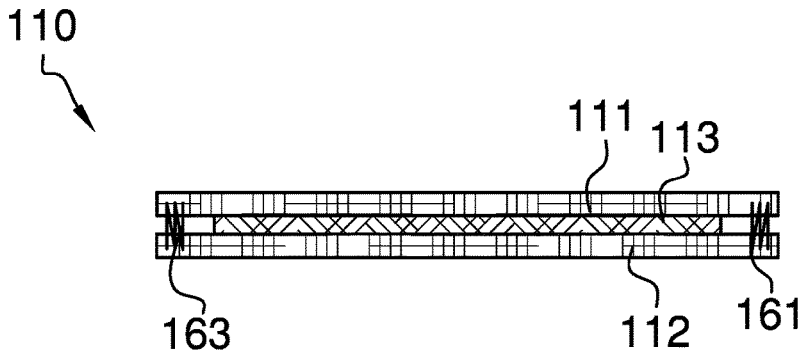
FIG. 8 is a cross-sectional view of an embodiment of the disclosure across 7-7 as shown on FIG. 4.
Figure 9:
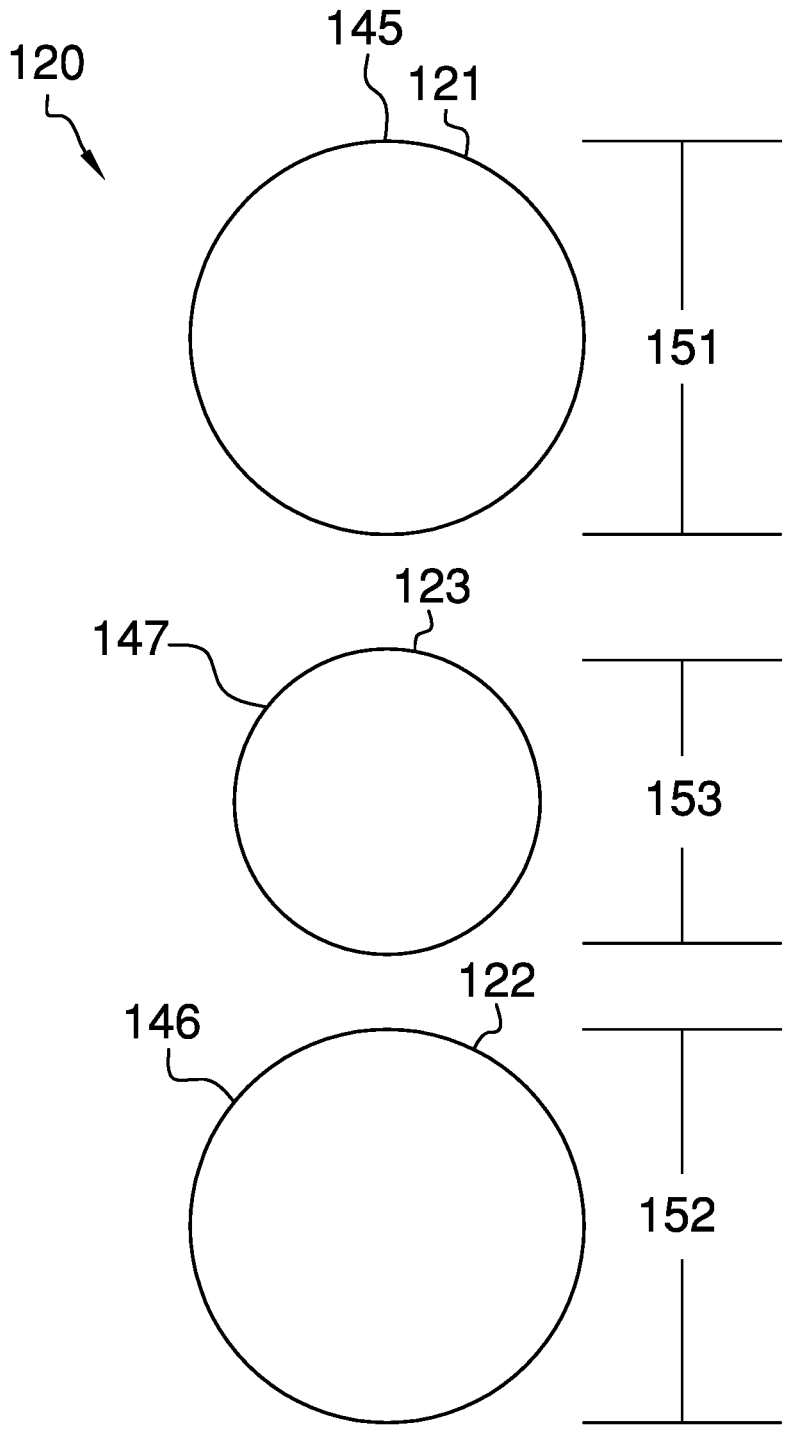
FIG. 9 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 10.

The decorative cover for a paper towel roll and holder 100 (hereinafter invention) is configured for use with a paper towel roll 181. The paper towel roll 181 is a readily and commercially available scroll of a paper product that is intended to be used as a towel. The invention 100 is placed over the paper towel roll 181 for decorative purposes. The paper towel roll 181 may be mounted on a paper towel holder 182. The paper towel holder 182 is a readily and commercially available device that receives and stores a paper towel roll 181 in such a manner that towels may be removed from the paper towel roll 181. The invention 100 comprises a cylinder 101, a top cap 102, and a slot 103. The cylinder 101 is defined with a vertical face 171, a superior base 172, and an inferior base 173. The vertical face 171 encloses the paper towel roll 181. The top cap 102 is a disk that encloses the superior base 172 of the cylinder 101. The slot 103 is an aperture formed in the vertical face 171 of cylinder 101. A free end 183 of the paper towel roll 181 is threaded through the slot 103 such that paper towels may be drawn out of the paper towel roll 181 without removing the invention 100. The free end 183 is an unattached end of the paper towel roll 181 from which towels are unrolled.

The cylinder 101 is a hollow cylindrical structure within which the paper towel roll 181 is stored. The cylinder 101 is an invertible structure that can be pulled "inside out" for decorative purposes. The cylinder 101 comprises a first composite textile 110. The first composite textile 110 is a textile base structure that forms the vertical face 171 of the cylinder 101.

The cylinder 101 is further defined with a vertical face 171, a superior base 172, and an inferior base 173. The vertical face 171 is the face of the cylinder 101. The superior base 172 is the base of the cylinder 101 that is in the superior position during normal use of the invention 100. The inferior base 173 is the base of the cylinder 101 that is distal from the superior base 172.

The first composite textile 110 comprises a first textile 111, a second textile 112, and a first stiffener 113. The first textile 111 is a readily and commercially available textile that is cut in a rectangular shape. The first textile 111 is selected for decorative purposes. The first textile 111 is further defined with a first edge 131, a second edge 132, a third edge 133, and a fourth edge 134. The span of the first edge 131 of the first textile 111 equals the span of the third edge 133 of the first textile 111. The span of the second edge 132 of the first textile 111 equals the span of the fourth edge 134 of the first textile 111.

The second textile 112 is a readily and commercially available textile that is cut in a rectangular shape. The second textile 112 is selected for decorative purposes. The second textile 112 is further defined with a fifth edge 135, a sixth edge 136, a seventh edge 137, and an eighth edge 138. The span of the fifth edge 135 of the second textile 112 equals the span of the seventh edge 137 of the second textile 112. The span of the sixth edge 136 of the second textile 112 equals the span of the eighth edge 138 of the second textile 112.

The first stiffener 113 is a readily and commercially available sheeting that is formed from a semi-rigid material with an elastic nature. The material used in the first stiffener 113 is selected such that the first stiffener 113 can be rolled to form a scroll. An example of suitable sheeting material is commonly marketed as a flexible plastic cutting mat. The first stiffener 113 is cut in a rectangular shape. The first stiffener 113 is further defined with a ninth edge 139, a tenth edge 140, an eleventh edge 141, and a twelfth edge 142. The span of the ninth edge 139 of the first stiffener 113 equals the span of the eleventh edge 141 of the first stiffener 113. The span of the tenth edge 140 of the first stiffener 113 equals the span of the twelfth edge 142 of the first stiffener 113.

The purpose of the first stiffener 113 within the first composite textile 110 is to provide the first composite textile 110 with a stiffness that allows the first composite textile 110: 1) to project perpendicularly away from the second composite textile 120; and, 2) to form the vertical face 171 of the cylinder 101.

The span of the first edge 131 of the first textile 111 equals the span of the fifth edge 135 of the second textile 112. The span of the second edge 132 of the first textile 111 equals the span of the sixth edge 136 of the second textile 112. The span of the first edge 131 of the first textile 111 is greater than the span of the ninth edge 139 of the first stiffener 113. The span of the second edge 132 of the first textile 111 is greater than the span of the tenth edge 140 of the first stiffener 113.

The top cap 102 is a disk shaped structure that forms the superior surface of the invention 100. The top cap 102 further comprises a top aperture 191 through the center of the top cap 102. The top aperture 191 is a hole formed through the center of the top cap 102 to allow top piece of a center post of a paper towel holder 182 to project through the top cap 102. The top cap 102 comprises a second composite textile 120. The second composite textile 120 is a textile base structure that forms the top cap 102. The second composite textile 120 comprises a third textile 121, a fourth textile 122, and a second stiffener 123.

The third textile 121 is a readily and commercially available textile that is cut in a circular shape. The third textile 121 is selected for decorative purposes. The third textile 121 is further defined with a first circumference 145 and a first diameter 151. The span of the first circumference 145 of the third textile 121 is greater than the span of the first edge 131 of the first textile 111.

The fourth textile 122 is a readily and commercially available textile that is cut in a circular shape. The fourth textile 122 is selected for decorative purposes. The fourth textile 122 is further defined with a second circumference 146 and a second diameter 152. The span of the first diameter 151 of the third textile 121 equals the span of the second diameter 152 of the fourth textile 122. The span of the first circumference 145 of the third textile 121 equals the span of the second circumference 146 of the fourth textile 122.

The second stiffener 123 is a sheeting that is formed from a semi-rigid material with an elastic nature. The material used in the second stiffener 123 is selected to be identical to the material used to form the first stiffener 113. The second stiffener 123 is cut in a circular shape. The second stiffener 123 is further defined with a third circumference 147 and a third diameter 153. The span of the first diameter 151 of the third textile 121 is greater than the span of the third diameter 153 of the second stiffener 123. The span of the first circumference 145 of the third textile 121 is greater than the span of the third circumference 147 of the second stiffener 123.

The first composite textile 110 is assembled with a first seam 161, a second seam 162, a third seam 163, and a fourth seam 164. The second composite textile 120 is assembled with a fifth seam 165. The second composite textile 120 attaches to the first composite textile 110 with a tenth seam 170.

The first composite textile 110 is a three layer composite textile wherein the first stiffener 113 is sandwiched between the first textile 111 and the second textile 112. The first stiffener 113 is positioned such that the center of the first stiffener 113 is aligned with the center of the first textile 111 and the center of the second textile 112. The first seam 161 attaches the first edge 131 of the first textile 111 to the fifth edge 135 of the second textile 112. The second seam 162 attaches the second edge 132 of the first textile 111 to the sixth edge 136 of the second textile 112. The third seam 163 attaches the third edge 133 of the first textile 111 to the seventh edge 137 of the second textile 112. The fourth seam 164 attaches the fourth edge 134 of the first textile 111 to the eighth edge 138 of the second textile 112.

The second composite textile 120 is a three layer composite textile wherein the second stiffener 123 is sandwiched between the third textile 121 and the fourth textile 122. The second stiffener 123 is positioned such that the center of the second stiffener 123 is aligned with the center of the third textile 121 and the center of the fourth textile 122. The fifth seam 165 attaches the first circumference 145 of the third textile 121 to the second circumference 146 of the fourth textile 122.

The invention 100 is assembled by attaching the second composite textile 120 to the first composite textile 110 using a tenth seam 170. The tenth seam 170 attaches the first circumference 145 of the third textile 121 to the first edge 131 of the first textile 111.

Because the span of the first edge 131 of the first textile 111 is lesser than the span of the first circumference 145 of the third textile 121 the first edge 131 will not completely encircle the first circumference 145 thereby leaving a gap. This gap forms the slot 103 of the invention 100. After the second composite textile 120 is attached to the first composite textile 110, the second composite textile 120 forms the superior base 172 of the cylinder 101. The inferior base 173 of the cylinder 101 is by design open such that the paper towel roll 181 and the paper towel holder 182 can be inserted into the inferior base 173 of the cylinder 101.

In a second potential embodiment of the disclosure, the invention 100 further comprises a first border 124 and a second border 125. The first border 124 is a readily and commercially available textile that is cut in a rectangular shape. The first border 124 is a decorative element that covers the slot 103 at the location next to the top cap 102. The second border 125 is a readily and commercially available textile that is cut in a rectangular shape. The second border 125 is a decorative element that covers the slot 103 at the location next to the top cap 102.

Figure 10:
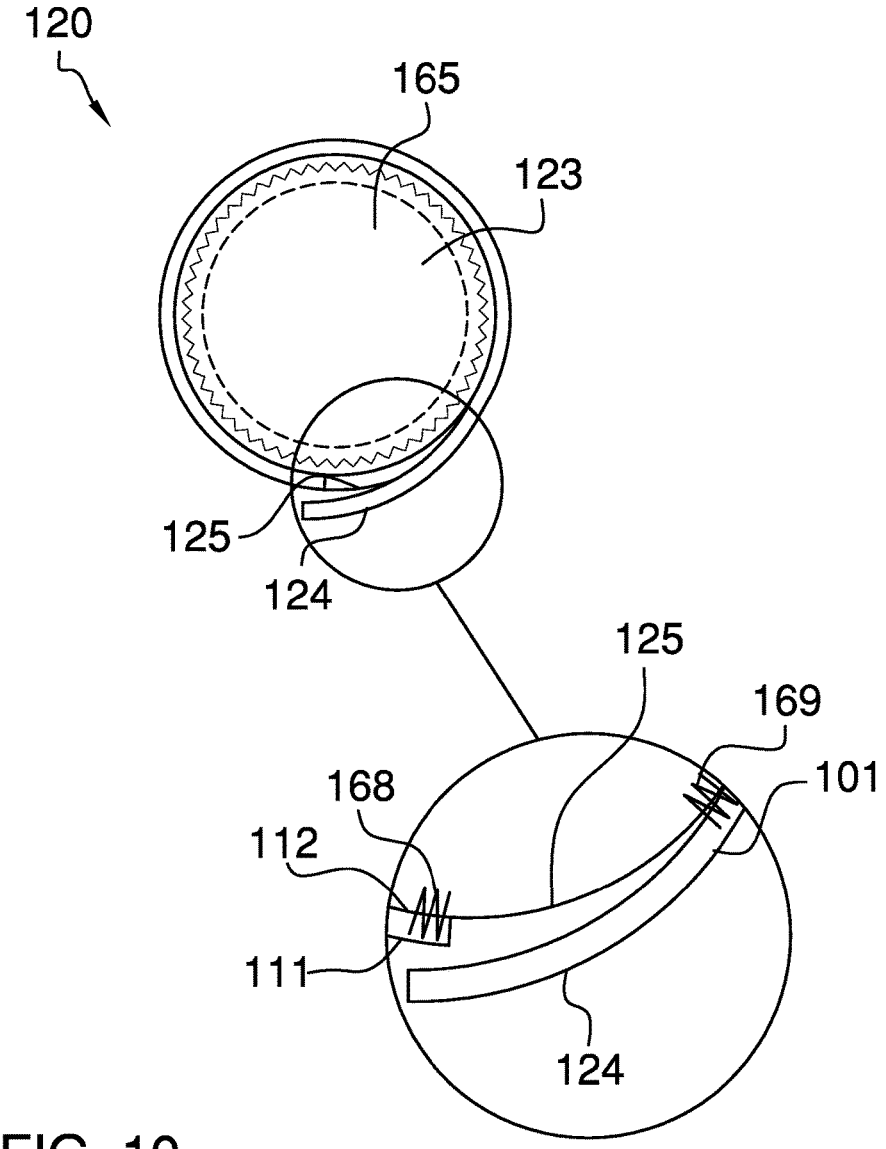
FIG. 10 is a detail view of an embodiment of the disclosure.

As shown most clearly in FIG. 10, the first border 124 and the second border 125 attach to the first composite textile 110. The first border 124 attaches to the first composite textile 110 with a sixth seam 166 and a seventh seam 167. The second border 125 attaches to the first composite textile 110 with an eighth seam 168 and a ninth seam 169. Specifically, the seventh seam 167 attaches the first border 124 to the corner formed by the first edge 131 and the second edge 132 of the first textile 111. The sixth seam 166 attaches the first border 124 to the corner formed by the first edge 131 and the fourth edge 134 of the first textile 111. The ninth seam 169 attaches the second border 125 to the corner formed by the fifth edge 135 and the sixth edge 136 of the second textile 112. The eighth seam 168 attaches the second border 125 to the corner formed by the fifth edge 135 and the eighth edge 138 of the second textile 112.

In the first potential embodiment of the disclosure, and the second potential embodiment of the disclosure, the first seam 161, the second seam 162, the third seam 163, the fourth seam 164, the fifth seam 165, the sixth seam 166, the seventh seam 167, the eighth seam 168, the ninth seam 169, and the tenth seam 170 are all sewn seams.

In a third potential embodiment of the disclosure, the invention 100 further comprises a bottom cap 104. The bottom cap 104 is identical in size and construction to the top cap 105. The bottom cap 104 further comprises a bottom aperture 192 formed through the center of the bottom cap 104. The bottom aperture 192 is a hole formed through the center of the bottom cap 104 such that the center post of a paper towel holder 182 can be inserted through the bottom cap 104. The bottom cap 104 is attached to the inferior base of the cylinder 101 in a manner identical to the attachment of the top cap 102 as described in the first potential embodiment of the disclosure.

To use the invention 100, the paper towel roll 181, and optionally the paper towel holder 182, is inserted into the inferior base 173 of the cylinder 101 such that the cylinder 101 and the top cap 102 enclose the paper towel roll 181. The free end 183 of the paper towel roll 181 is threaded through the slot 103. To change the exterior surface of the invention 100 between the first textile 111 and the second textile 112 the top cap 102 is pushed through the inferior base 173 of the cylinder 101.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Composite Textile: As used in this disclosure, a composite textile is a multilayer fabric made of two or more joined layers of textile or sheeting materials.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight-line segment that passes through the center of an object. The line segment of the diameter is terminated at the perimeter or boundary of the object through which the line segment of the diameter runs.

Disk: As used in this disclosure, a disk is a cylindrically shaped object that is flat in appearance.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Interior: As used in this disclosure, the interior is use as a relational term that implies that an object is contained within the boundary of a structure or a space.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat-bonded seam, an ultrasonically bonded seam, or a seam formed using an adhesive.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Slot: As used in this disclosure, a slot is a long narrow groove or aperture that is formed in an object.

Superior: As used in this disclosure, the term superior refers to a directional reference that is parallel to and in the opposite direction of the force of gravity.

Textile: As used in this disclosure, a textile is a material that is woven, knitted, braided or felted. Synonyms in common usage for this definition include fabric and cloth.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic article comprising:

a cylinder, a top cap, and a slot;

wherein the cylinder attaches to the top cap;

wherein the top cap is a disk that encloses the superior base of the cylinder;

wherein the slot is an aperture formed in the vertical face of cylinder;

wherein the cylinder is defined with a vertical face, a superior base, and an inferior base;

wherein the domestic article is configured for use with a paper towel roll;

wherein the paper towel is further defined with a free end;

wherein the domestic article is configured for use with a paper towel holder;

wherein a paper towel roll is placed within the cylinder;

wherein a free end of the paper towel roll is threaded through the slot;

wherein the cylinder is a hollow cylindrical structure;

wherein the cylinder is an invertible structure;

wherein the cylinder comprises a first composite textile;

wherein the first composite textile is a textile structure that forms the vertical face of the cylinder;

wherein the cylinder is further defined with a vertical face, a superior base, and an inferior base;

wherein the vertical face is the face of the cylinder;

wherein the superior base is the base of the cylinder that is in the superior position;

wherein the inferior base is the base of the cylinder that is distal from the superior base.

2. The domestic article according to claim 1 wherein the first composite textile comprises a first textile and a second textile;

wherein the first textile attaches to the second textile;

wherein the first textile is a textile that is cut in a rectangular shape;

wherein the first textile is further defined with a first edge, a second edge, a third edge, and a fourth edge;

wherein the second textile is a textile that is cut in a rectangular shape;

wherein the second textile is further defined with a fifth edge, a sixth edge, a seventh edge, and an eighth edge.

3. The domestic article according to claim 2 wherein the first composite textile further comprises a first stiffener;

wherein the first stiffener attaches to the first textile and the second textile;

wherein the first stiffener is sheeting that is formed from a semi-rigid material with an elastic nature;

wherein the material used to form the first stiffener is selected such that the first stiffener can be rolled to form a scroll;

wherein the first stiffener is cut in a rectangular shape;

wherein the first stiffener is further defined with a ninth edge, a tenth edge, an eleventh edge, and a twelfth edge.

4. The domestic article according to claim 3 wherein the span of the first edge of the first textile equals the span of the third edge of the first textile;

wherein the span of the second edge of the first textile equals the span of the fourth edge of the first textile;

wherein the span of the fifth edge of the second textile equals the span of the seventh edge of the second textile;

wherein the span of the sixth edge of the second textile equals the span of the eighth edge of the second textile;

wherein the span of the ninth edge of the first stiffener equals the span of the eleventh edge of the first stiffener;

wherein the span of the tenth edge of the first stiffener equals the span of the twelfth edge of the first stiffener;

wherein the span of the first edge of the first textile equals the span of the fifth edge of the second textile;

wherein the span of the second edge of the first textile equals the span of the sixth edge of the second textile;

wherein the span of the first edge of the first textile is greater than the span of the ninth edge of the first stiffener;

wherein the span of the second edge of the first textile is greater than the span of the tenth edge of the first stiffener.

5. The domestic article according to claim 4 wherein the top cap comprises a second composite textile and a top aperture;

wherein the top cap is further defined with a top center;

wherein the top cap is a disk shaped structure;

wherein the top aperture is formed through the top center of the top cap;

wherein the top cap forms the superior surface of the domestic article;

wherein the top cap is a disk that encloses the superior base of the cylinder.

6. The domestic article according to claim 5 wherein the second composite textile comprises a third textile and a fourth textile;

wherein the third textile attaches to the fourth textile;

wherein the third textile is a textile that is cut in a circular shape;

wherein the third textile is further defined with a first circumference and a first diameter;

wherein the fourth textile is a textile that is cut in a circular shape;

wherein the fourth textile is further defined with a second circumference and a second diameter.

7. The domestic article according to claim 6 wherein the second composite textile further comprises a second stiffener;

wherein the second stiffener attaches to the third textile and the fourth textile;

wherein the material used in the second stiffener is identical to the material used to form the first stiffener;

wherein the second stiffener is cut in a circular shape;

wherein the second stiffener is further defined with a third circumference and a third diameter.

8. The domestic article according to claim 7 wherein the span of the first diameter of the third textile equals the span of the second diameter of the fourth textile;

wherein the span of the first circumference of the third textile equals the span of the second circumference of the fourth textile;

wherein the span of the first diameter of the third textile is greater than the span of the third diameter of the second stiffener;

wherein the span of the first circumference of the third textile is greater than the span of the third circumference of the second stiffener.

9. The domestic article according to claim 8 wherein the span of the first circumference of the third textile is greater than the span of the first edge of the first textile.

10. The domestic article according to claim 9 wherein the first composite textile is a three layer composite textile wherein the first stiffener is sandwiched between the first textile and the second textile.

11. The domestic article according to claim 10 wherein the first stiffener is positioned such that the center of the first stiffener is aligned with the center of the first textile and the center of the second textile;

wherein the first composite textile is assembled with a first seam, a second seam, a third seam, and a fourth seam;

wherein the first seam attaches the first edge of the first textile to the fifth edge of the second textile;

wherein the second seam attaches the second edge of the first textile to the sixth edge of the second textile;

wherein the third seam attaches the third edge of the first textile to the seventh edge of the second textile;

wherein the fourth seam attaches the fourth edge of the first textile to the eighth edge of the second textile.

12. The domestic article according to claim 11 wherein the first composite textile is a three layer composite textile wherein the first stiffener is sandwiched between the first textile and the second textile.

13. The domestic article according to claim 12 wherein the second stiffener is positioned such that the center of the second stiffener is aligned with the center of the third textile and the center of the fourth textile.

14. The domestic article according to claim 13 wherein the second composite textile is assembled with a fifth seam;

wherein the fifth seam attaches the first circumference of the third textile to the second circumference of the fourth textile.

15. The domestic article according to claim 14 wherein the second composite textile attaches to the first composite textile with a tenth seam;

wherein the tenth seam attaches the first circumference of the third textile to the first edge of the first textile.

16. The domestic article according to claim 15 wherein the domestic article further comprises a first border and a second border;

wherein the first border is a textile that is cut in a rectangular shape;

wherein the second border is a textile that is cut in a rectangular shape;

wherein the first border attaches to the first composite textile;

wherein the second border attaches to the first composite textile;

wherein the first border covers the slot at a first location next to the top cap;

wherein the second border covers the slot at a second location next to the top cap;

wherein the first border attaches to the first composite textile with a sixth seam and a seventh seam;

wherein the seventh seam attaches the first border to the corner formed by the first edge and the second edge of the first textile;

wherein the sixth seam attaches the first border to the corner formed by the first edge and the fourth edge of the first textile;

wherein the second border attaches to the first composite textile with an eighth seam and a ninth seam;

wherein the ninth seam attaches the second border to the corner formed by the fifth edge and the sixth edge of the second textile;

wherein the eighth seam attaches the second border to the corner formed by the fifth edge and the eighth edge of the second textile.

17. The domestic article according to claim 16 wherein to change the exterior surface of the domestic article between the first textile and the second textile the top cap is pushed through the inferior base of the cylinder.

18. The domestic article according to claim 15 wherein the domestic article further comprises a bottom cap;

wherein the bottom cap is identical in construction to a top cap;

wherein the bottom cap further comprises a bottom aperture;

wherein the bottom cap is further defined with a bottom center;

wherein the bottom aperture is formed through the bottom center of the bottom cap;

wherein the bottom cap forms the inferior surface of the domestic article;

wherein the bottom cap encloses the inferior base of the cylinder.

19. The domestic article according to claim 18 wherein the domestic article further comprises a first border and a second border;

wherein the first border is a textile that is cut in a rectangular shape;

wherein the second border is a textile that is cut in a rectangular shape;

wherein the first border attaches to the first composite textile;

wherein the second border attaches to the first composite textile;

wherein the first border covers the slot at a first location next to the top cap;

wherein the second border covers the slot at a second location next to the top cap;

wherein the first border attaches to the first composite textile with a sixth seam and a seventh seam;

wherein the seventh seam attaches the first border to the corner formed by the first edge and the second edge of the first textile;

wherein the sixth seam attaches the first border to the corner formed by the first edge and the fourth edge of the first textile;

wherein the second border attaches to the first composite textile with an eighth seam and a ninth seam;

wherein the ninth seam attaches the second border to the corner formed by the fifth edge and the sixth edge of the second textile;

wherein the eighth seam attaches the second border to the corner formed by the fifth edge and the eighth edge of the second textile.

* * * * *